United States Patent [19]

Danielson

[11] Patent Number: 5,054,792

[45] Date of Patent: Oct. 8, 1991

[54] DART GAME SCORING SYSTEM

[76] Inventor: Robert J. G. Danielson, 755 E. Virginia Way, No. 34, Barstow, Calif. 92311

[21] Appl. No.: 566,998

[22] Filed: Aug. 13, 1990

Related U.S. Application Data

[63] Continuation-in-part of Ser. No. 370,465, Jun. 23, 1989, Pat. No. 4,948,148.

[51] Int. Cl.[5] ..... F41J 1/16

[52] U.S. Cl. ..... 273/408; 116/222; 116/325; 273/DIG. 26

[58] Field of Search ..... 273/408, DIG. 26; 116/222, 325, 326

[56] References Cited

U.S. PATENT DOCUMENTS

| | | | |
|---|---|---|---|
| 592,081 | 10/1897 | Crocker . | |
| 1,656,993 | 1/1928 | Searle . | |
| 2,794,642 | 6/1957 | O'Neill | 273/256 |
| 2,900,188 | 8/1959 | Lemon | 273/408 |
| 3,059,928 | 10/1962 | Flanagan | 273/408 |
| 3,979,117 | 9/1976 | Worsham | 273/408 |
| 4,332,386 | 6/1982 | Townsend | 273/148 A |
| 4,651,998 | 3/1987 | Holt et al. | 273/DIG. 26 X |

FOREIGN PATENT DOCUMENTS

| | | | |
|---|---|---|---|
| 1503114 | 3/1978 | United Kingdom | 273/408 |

OTHER PUBLICATIONS

"Smart Darts TM" flyer; Arachnid; Rockford, Ill.; 1 p.; no date.

*Primary Examiner*—William H. Grieb
*Attorney, Agent, or Firm*—Sheldon & Mak

[57] ABSTRACT

A scoring system for a dart game apparatus includes a target wall for mounting a dart board, a supply of at least two visually distinctive kinds of scoring markers for association with corresponding players of the game, the markers of opposing players being stackable, and a scoring panel having a modular pattern of marker positions in a plurality of array portions, each marker position being formed as a hole in the panel for releasably receiving the stem of a marker, and a pattern of score keeping indicia on the scoring panel for defining a scoring value and a required number of occurrences of the scoring value for at least one of the array portions for recording multiple required occurrences of predetermined game score increments in a first game, and for defining a scoring increment for each of at least two of the array portions, the increments being in a fixed ratio for indicating a player's score in a second game by the position of markers in the segments as a summation of the position of each marker in its segment multiplied by the scoring increment of that segment. The system provides convenient scoring of "301 Series" games as well a "Cricket", "Tic-Tac-Darts", "Horse", "Baseball", and "Cut Throat". In one variation, a modular frame assembly is configured for scoring the 301 games in a first panel region, with interchangeable game cards used in a second grid panel region for scoring the additional games.

25 Claims, 3 Drawing Sheets

DART GAME SCORING SYSTEM

RELATED APPLICATION

This application is a continuation-in-part of application Ser. No. 370,465, filed on June 23, 1989, now U.S. Pat. No. 4,948,148, issued Aug. 14, 1990.

BACKGROUND

The present invention relates to game scoring systems and, more particularly to a dart game scoring system.

A variety of dart games are based on successive attempts by one or more players to propel darts for striking particular regions of a target, the regions having associated scoring values for defining progress of the game. Many such games have elaborate scoring rules, ostensibly for imparting interest and elements of strategy. However, elaborate scoring can be prohibitively difficult to keep track of.

In the game of "Cricket", for example, the object is to be the first player to hit a bull's-eye and six other numbered regions of the target three times each. In a variation of this game, it is also possible to accumulate bonus points for extra hits within the designated regions. In another game, each player begins with a predetermined number of points, such as 301, 501, etc., the object being to go "out" by scoring the same exact number of point values. Typically the target has pie-shaped regions that are numbered from 1 to 20, the regions having smaller subregions that count double or triple the designated value. Thus for each hit it is required to subtract from one's current score a value which is the product of from 1 to 3 and from 1 to 20. With such scoring complexity, some means for recording the progress of the game is a practical necessity.

One scheme is simply to keep score on paper. This is cumbersome, however, and there is often a lack of a suitable writing surface. Also, it may be difficult for each player to see what has been recorded. Another approach is to provide an electronic or computer-based display system. Although there is no limit to the capability and complexity of a computer scoring system, all such systems are expensive to produce and require some form of electrical power.

Thus there is a need for a dart game scoring system that is effective for recording and displaying the progress of a variety of dart games, that is inexpensive to produce, and is easy to use.

SUMMARY

The present invention meets this need by providing a simple mechanical dart game scoring system including, in one aspect of the invention, a supply of markers for use by players of the game; a scoring panel having a modular pattern of marker positions on the scoring panel forming at least one distinct array portion, means for releasably holding one or more of the markers in association with a selected marker position; and selector means for removably registering a selected game pattern of score keeping indicia on the scoring panel and associated with ones of the marker positions, the indicia defining a scoring indicator for each of the array portions for indicating progress of the game. Thus the invention provides an easily read display of scores that does not require an excessive number of marker positions. Typically, the dart game is played with a target and a plurality of darts for shooting at selected regions of the target, each region having an associated scoring value for generating a corresponding game score value when a dart hits that region of the target.

The modular pattern can be a first modular pattern, the panel also including a second modular pattern of the marker positions forming at least two distinct array portions and including means for indicating a game score value as a summation of the position of each marker in its array portion multiplied by a scoring increment of that portion.

One array portion of the system can include a rectangular sub-array portion having a first number of positions in one direction and a second number of positions in an orthogonal direction, the indicia defining the scoring increment in the one direction and the scoring increment multiplied by the first number in the orthogonal direction. As used herein, the term "orthogonal direction" means a direction along which the position in the one direction remains fixed. Thus a player can quickly record a new game score value by moving a marker from its old position to a new row according to the score value divided by the first number, and a new column according to the division remainder. The scoring increment of a second sub-array portion of the marker positions is the product of the scoring increment of the first array portion, the first number of positions, and the second number of positions. The scoring increment of the first array portion is unity, the first number is five, the second number is ten, and the scoring increment of the second segment is fifty. Thus a player's marker can be moved in a column between rows as the game score value is counted by "fives". Preferably the first sub-array portion includes a starting position having an associated indicia for a value of 51 for recording initial points of the games of 301, 501, 751, etc.

The system preferably includes at least two visually distinctive kinds of the markers for association with corresponding players of the game, at least one of the array portions being capable of receiving at least two of the kinds of markers in each position for permitting opponents' markers to simultaneously occupy a single position of the segment. The panel can be formed with an opening at each marker position, each marker having a body portion and a stem portion for engaging a selected opening of the panel, at least some of the markers having a body cavity for receiving a stem portion of another marker whereby the markers of opposing players may be stacked. At least a portion of the panel can be formed from a transparent material, and the selector means includes a selector substrate having indicia for the selected pattern formed thereon and means for locating the substrate for viewing through the panel portion, the indicia of the substrate being visible through the panel portion. Preferably the means for locating the substrate includes a substrate cavity for receiving a stack of the selector substrates, the selected substrate being located at a front extremity of the stack most proximate the panel portion.

In at least one game, a predetermined number of occurrences of at least one of the game score values can be required for a player to win the game, the indicia defining a scoring value and a required number of occurrences of the scoring value for at least one of the array portions. The target can have a bull's-eye region and at least six other labeled regions, the panel having at least seven array portions, the seven array portions having associated indicia corresponding, respectively, to the bull's-eye region and each of the six labeled regions, each of the seven array portions having at least three marker positions for recording a like number of the required occurrences. This configuration of the invention is particularly suitable for storing the game of Cricket.

At least some of the target regions can have at least one subregion for designating a predetermined multiple of the scoring value for that region, the multiple of the scoring value being used as the game score value in at least one game, the system further including a chart of the scoring value and associated game score values for each of the regions and subregions.

The system can also include a target wall connected to the scoring panel for mounting a dart board, and means connected to the wall for storing the markers. The means for storing the markers can include a cabinet structure of the system having opposite side members, a bottom member, and a back member that is formed by the target wall, and a panel member of the scoring panel pivotally connected to the cabinet portion. The cabinet structure can have a shelf member and a front member, the panel member being pivotally connected to the shelf member, downwardly sloping to a closed position against the front member, the target wall extending above the shelf member. Alternatively, the cabinet structure can include a pair of the panel members, each being pivotally connected to one of the side members and closing edgewise for covering the target, the marker positions and associated indicia being visible with the panel members opened outwardly.

In another aspect, the system includes the supply of markers and the scoring panel, the panel having the modular pattern of marker positions and associated indicia for the required number of occurrences of each scoring value, and the means for holding the markers for recording each required occurrence of a scoring value. At least some of the markers can be labelled, each of the labeled markers being labeled in association with a particular one of the target regions, means being provided for randomly selecting a subset of the labeled markers. Each of the labeled markers can include a head portion having a face region for its label, the markers being movable face-down on a supporting surface without revealing the labels such that the labeled markers of the subset are sequentially selectable for location on the panel in association with successive ones of the array portions. This configuration of the invention is particularly suitable for storing the game of "Tic-Tac-Darts" wherein players seek to claim, indicating by marking with an "X" or "O", grid portions of the scoring panel, the first player obtaining three markers in a row being the winner.

In a further aspect of the invention, at least one game has one or more occurrences of required game score values can be required for a player to win the game, the system including the supply of markers and the scoring panel, the modular pattern forming a play array portion and at least one marker position for displaying a required game score value, the pattern of score keeping indicia for indicating a number of occurrences of the required game score value, and the means for holding the markers. The play array portion can include a player array portion for each of the players, the pattern of score keeping indicia defining the required number of occurrences of the required game score values. The panel can include marker positions for indicating required game score values separately associated with each of the players. The pattern of marker positions can include a value array portion having a marker position for the game score value associated with at least some of the target regions, a portion of the score keeping indicia indicating the game score values of the value array portion. This configuration is particularly suitable for scoring the games of "Horse", wherein one player initially throws a dart for defining the required game scoring value; and "Cut Throat", wherein each player initially throws a dart for defining a required game score value for use against him by the other players. The play array portion can include a path portion having a plurality of the marker positions and associated indicia, one of the path portion marker positions being associated with a game point value, the play array portion also including a game point array portion for accumulating separate game point values for each of the players.

DRAWINGS

These and other features, aspects, and advantages of the present invention will become better understood with reference to the following description, appended claims, and accompanying drawings, where:

DESCRIPTION

Figure 4:
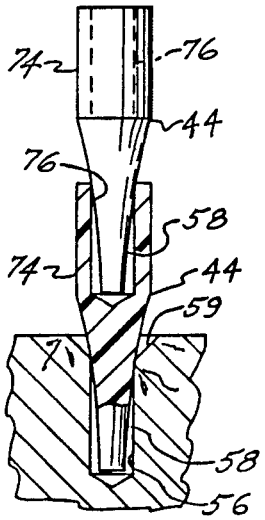
FIG. 4 is a sectional detail view of the system of FIG. 1 on line 4—4 of FIG. 3.

The present invention is directed to a simple yet versatile mechanical scoring system for dart games. With reference to FIGS. 1–4 of the drawings, a scoring system 10 includes a target wall 12 for mounting a conventional dart game target 14. The target 14, which is shown more completely in FIG. 5, has a plurality of target regions 18 including a bull's-eye region $\mathbf{18}_B$ and twenty pie-shaped regions $\mathbf{18}_n$ radiating therefrom, each of the pie shaped regions $\mathbf{18}_n$ having an associated target designator for defining a corresponding scoring value when that region is struck by a player's dart 20. Each of the pie-shaped regions 18 has a doubles subregion 22 and a triples subregion 24 for defining game score values as corresponding multiples of the respective scoring values when the dart 20 hits that subregion.

Figure 1:
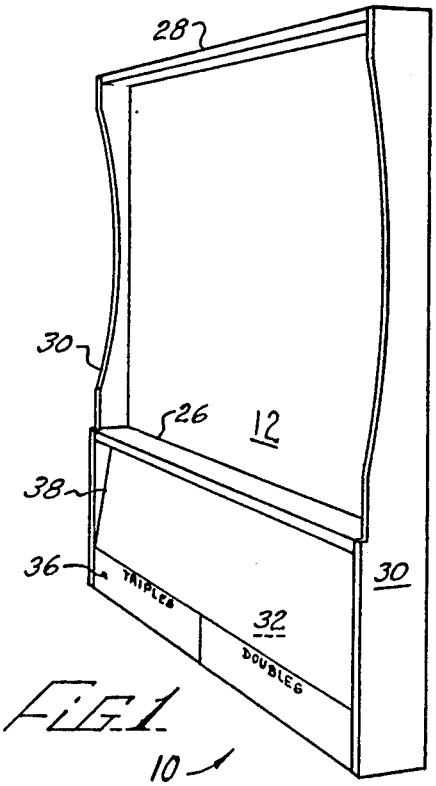
FIG. 1 is a perspective view of a dart game scoring system according to the present invention.

As best shown in FIG. 1, a shelf member 26, a top member 28, and opposite side members 30 extend forwardly from the target wall 12, the members together forming a rigid protective cavity for the target 14. A storage compartment 32 is formed below the shelf member 26 by a bottom member 34 (shown in FIG. 2), and a front member 36, in cooperation with portions of the target wall 12 and the side members 30 that extend below the shelf member 26. A scoring panel 38, further described below, is pivotally connected to the shelf member 26 by one or more hinges 40, the panel 38 having an open position as indicated by the dashed lines in FIG. 2, and a closed position in which the panel 38 slopes downwardly and forwardly from the hinge 40 into contact with the front member 26. An upstanding divider member 42 connects the target wall 12, the bottom member 34 and the front member 36 for dividing the compartment 32 between the side members 30, one side of the compartment 32 being provided for storage of the darts 20, the other side being for storing a quantity of scoring markers 44, described below.

Figure 3:
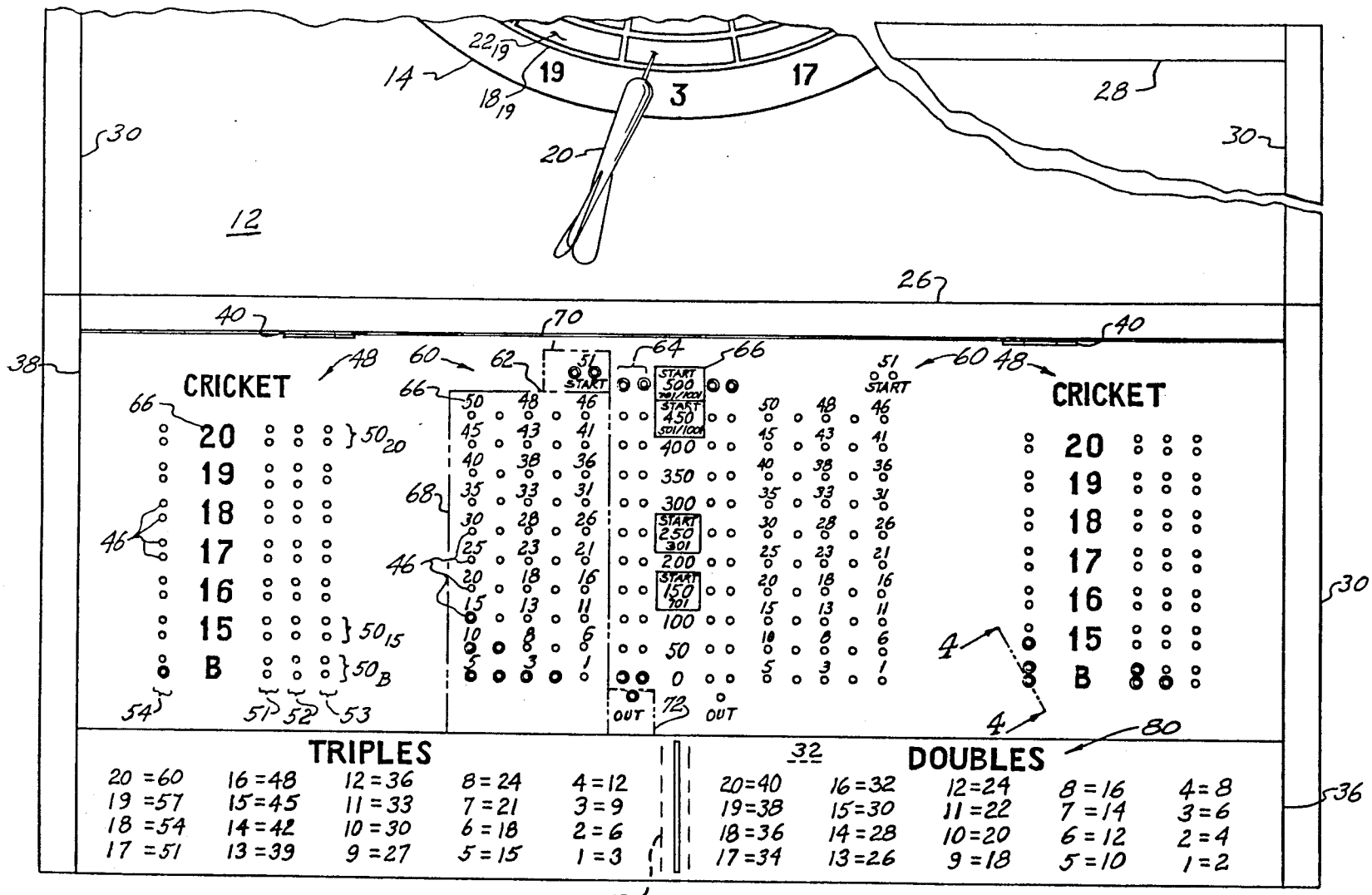
FIG. 3 is a fragmentary front detail view of the system of FIG. 1.

According to the present invention, the panel 38 has at least one array of marker positions 46 for selectively locating one or more of the markers 44, whereby the progress of a dart game may be recorded and displayed. With particular reference to FIGS. 3 and 4, the panel 38 is formed with a pair of "cricket" arrays 48 for use in scoring the game of Cricket, wherein a predetermined number of occurrences of at least one of the game score values is required for a player to win the game.

In one version of Cricket, the object is to be the first to hit the regions $\mathbf{18}_B$ and $\mathbf{18}_{15}$ through $\mathbf{18}_{20}$ three times each. For scoring this game, each of the cricket arrays 48 has a plurality of array row segments 50, designated $\mathbf{50}_B$ and $\mathbf{50}_{15}$ through $\mathbf{50}_{20}$, corresponding respectively to the target regions 18 that are required to be hit, each of the row segments 50 having an associated indicia that corresponds to the respective one of the target regions 18. For each of two players, the cricket array 48 has a first column 51, a second column 52, a third column 53, and a start column 54, there being a pair of the marker positions 46 at the intersection of each of the columns 51–54 with each of the row segments 50. Each of the marker positions 46 is formed as a cavity or hole 56 in the panel 38 for receiving a stem portion 58 of one of the markers 44, as shown in FIG. 4. Separate visually distinctive kinds of the markers 44 are provided by forming them in contrasting colors for the different players. Each of the marker positions 46 is formed with a countersink 59 of the hole 56, the countersink 59 serving to guide the stem portion of the marker 44 into the hole 56, the countersink 59 also being colored to match the color of the markers 44 for use by one of the players. Thus the system 10 having the pair of cricket arrays 48 and markers 44 provides a convenient way for up to four players to record and display the progress of Cricket. In another version of Cricket, further described below, bonus points are awarded, the system 10 recording and displaying the bonus points.

Another and popular dart game is called "301", in which each player has a starting point value of 301, the object being to go "out", is decrementing the point value to exactly zero by a succession of game score values. Variations of this game, which are similarly named, have starting point values of 501, 701, 1001, and 1501, the games being collectively designated herein as the "301 Series" games.

For scoring the 301 Series games, the system 10 provides a pair of modular arrays 60 of the marker positions 46 on the scoring panel 38. Each of the modular arrays 60 has a first array segment or portion 62, a second array segment or portion 64, and a pattern of numerical indicia 66, each of the indicia 66 being associated with one of the marker positions 46 within the array 60. As best shown in FIG. 3, the first array portion 62 has a rectangular array portion 68, a start array portion 70 having a pair of the marker positions 46, and an out array portion 72, having at least one of the positions 46. The rectangular portion 68 has ten rows of five columns, providing fifty of the marker positions 46. The positions 46 within the rectangular portion 68 are numbered by the indicia 66 for defining a scoring increment of unity; beginning at the lower right of the portion 68, the odd positions 46 in the lowest row are numbered "1", "3", and "5", the corresponding column positions 46 in the succeeding rows being numbered by the indicia 66 in respective multiples of five greater than the lowermost of the positions 46 in those columns. The pair of marker positions 46 of the start array portion 70 is labeled by one of the indicia 66 as having a value of 51. Thus the first array portion 62 is capable of storing and displaying each integer value from zero ("Out") to 51 ("Start"). Moreover, the rectangular array portion 68 is capable of recording separate values for each of two or more players, even in cases of identical values, because at least some of the markers 44 are formed with a body portion 74 having a cavity 76 therein for receiving the stem portion 58 of an opponent's marker 44, whereby opponent's markers 44 may be stacked at a single marker position 46 of the rectangular array portion 68, significantly reducing the number of the holes 56 that are required to be formed in the panel 38 for a given capacity of the first array portion.

The second array portion 64 of the modular array 60 has a pair of columns of the marker positions 46 for each of two players, the positions 46 being numbered by the indicia 66 in increments of 50, corresponding to the number of the positions 46 within the rectangular array portion 68 of the associated first array portion 62. As shown in FIG. 3, there are for each player eleven of the positions 46 in the second array portion 64, the positions 46 being numbered by the indicia 66 from zero to 500. Also, the second array portions 64 of each modular array 60 are centrally located on the panel 38, on opposite sides of a single set of the indicia 66. Further, several of the indicia 66 identify the associated positions 46 as being starting locations for the games 301, 501, 701, and 1001. For example, the positions 46 having the value 250 are indicated as being starting locations for "301". In that game, a starting point value of 301 is recorded and displayed by locating one of a player's markers 44 in the start array portion 70 of the first array portion 62 (indicating a point value of 51), and another of the markers 44 in the second array portion 64 at that player's position 46 having the value 250. Alternatively, the marker 44 in the second array portion 64 is initially located at the position 46 having the value of 450 for playing "501". In the game "701", two of the markers 44 are used, at the positions 46 having the values 150 and 500, indicating, together with the marker 44 in the start array portion 70, a total starting point value of 701. Further, a starting point value of 1001 for the game "1001" is indicated by locating the two markers 44 within the second array portion 64 at the positions 46 having the values 450 and 500. Moreover, a pair of the markers 44 can be stacked at the position 46 valued 500, a total of four of the markers 44 recording and displaying a player's starting point value of 1501 for the game "1501".

In each of the 301 Series games, a player's game score value in one turn of the game is recorded and displayed by first dividing the score value by the scoring increment of the second array portion 64, moving one of the markers 44 from its prior position in the second array portion 64 to a new position having a lesser value by the amount of the integer result, if any. The remainder, if any, of this first division is recorded and displayed by moving that player's marker 44 within the first array portion 62 as described herein. A second division is performed, the remainder from the first division being divided by the number of columns of marker positions 46 in the rectangular array portion 68. The marker 44 is moved downwardly toward the out array portion 72 by a number of rows corresponding to the integer result of this second division, the marker 44 also being moved to the right by a number of columns corresponding to the remainder from the second division. If necessary, five column positions are "borrowed" from a row position in the first array portion 62. Also, ten row positions of the first array portion 62 are borrowed from one position of a marker 44 within the second array portion 64, if necessary. For a player to win the game, the game score value for that player's last turn must be such that the new position of the player's markers 44 is with the marker 44 in the first array portion 62 in the out array portion 72, with all of that player's markers 44 in the second array portion 64 located at the position 46 having the value of zero. In case a player's game score value in a turn is greater than that player's point value, the game score value for that turn is forfeited.

The system 10 also includes a multiples chart 80 of the possible scoring values from 1 to 20, with corresponding "doubles" values from 2 to 40, and "triples" values from 3 to 60, the chart 80 being provided on the front member 36 as shown in FIG. 3. The multiples chart 80 conveniently and inexpensively facilitates a determination of game score values in cases where a player's dart 20 hits one of the doubles subregions 22 or triples subregions 24.

Figure 5:
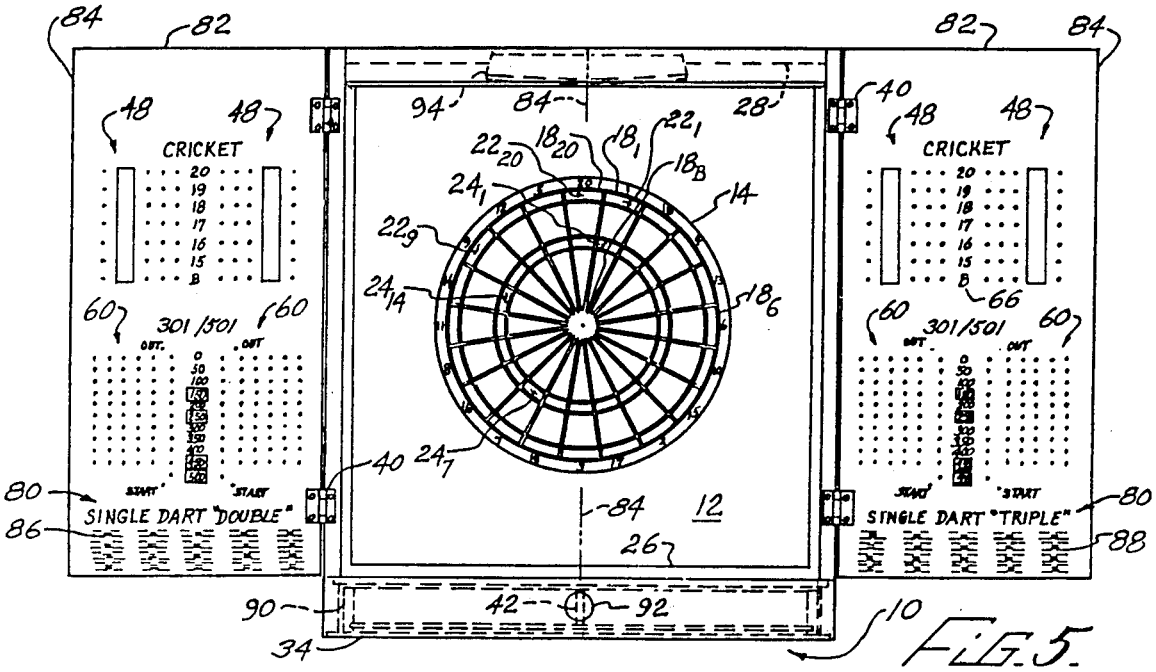
FIG. 5 is a front elevational view of an alternative configuration of the system of FIG. 1.

With further reference to FIG. 5, an alternative configuration of the system 10 has the scoring panel 38 divided into a pair of door panels 82, each of the panels 82 being pivotally connected to a corresponding one of the side members 30 by one or more of the hinges 40. The panels 82 are movable between an open position, extending oppositely from the side members for exposing the target 14, and a closed position covering the target 14, respective edge portions 84 of the panels 82 being proximately connected as shown by dashed lines in FIG. 5.

The marker positions 46 and the indicia 66 are exposed on the panels 82 in the open position. In this configuration, each of the door panels 82 has a pair of the cricket arrays 48, the arrays 48 of each pair sharing one complement of the indicia 66 for the respective row segments 50, only one marker position 46 being provided in each row and column of each array 48. Thus the four cricket arrays 48 shown in FIG. 5 provide scoring locations for a like number of players, whereas the same number of players are accommodated by only two of the arrays 48 in the configuration of FIG. 3.

Figure 2:
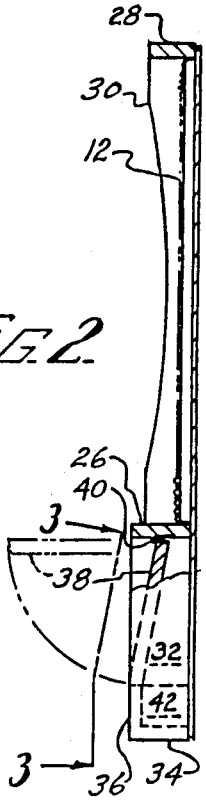
FIG. 2 is a fragmentary sectional elevational side view of the system of FIG. 1.

Each of the door panels 82 also has a pair of the modular arrays 60, a single centrally located complement of the indicia 66 being located between adjacent second array portions 64 of the arrays 60, the portions 64 each having only one column of the marker positions 46 for use in recording game score values of one player. Thus the configuration of the system 10 shown in FIG. 5 provides for recording the progress of both Cricket and 301 Series dart games with up to four players, without requiring simultaneous use of any one cricket array 48 or modular array 60 by more than one player. Another variation of the system 10 of FIG. 5 from that shown in FIGS. 1–3 is that each of the modular arrays 60 is inverted, the start array portion 70 being located below the rectangular array portion 68 (the portion 70 also having only one of the marker positions 46), the out array portion 72 being above the portion 68. Further, a doubles portion 86 of the multiples chart 80 is provided on one of the door panels 82, a triples portion 88 of the chart 80 being provided on the other of the door panels 82. Moreover, a drawer 90 is slidably connected between the side members 30 proximate the bottom member 34, the drawer 90 functioning as the compartment 32, having a drawer pull 92 and a counterpart of the divider member 42 for storing the darts 20 separately from the markers 44. Also, the system 10 includes a lamp assembly 94 for illuminating the target 14, the lamp assembly 94 being mounted to the underside of the top member 28.

Figures 6, 7, 8, 9:
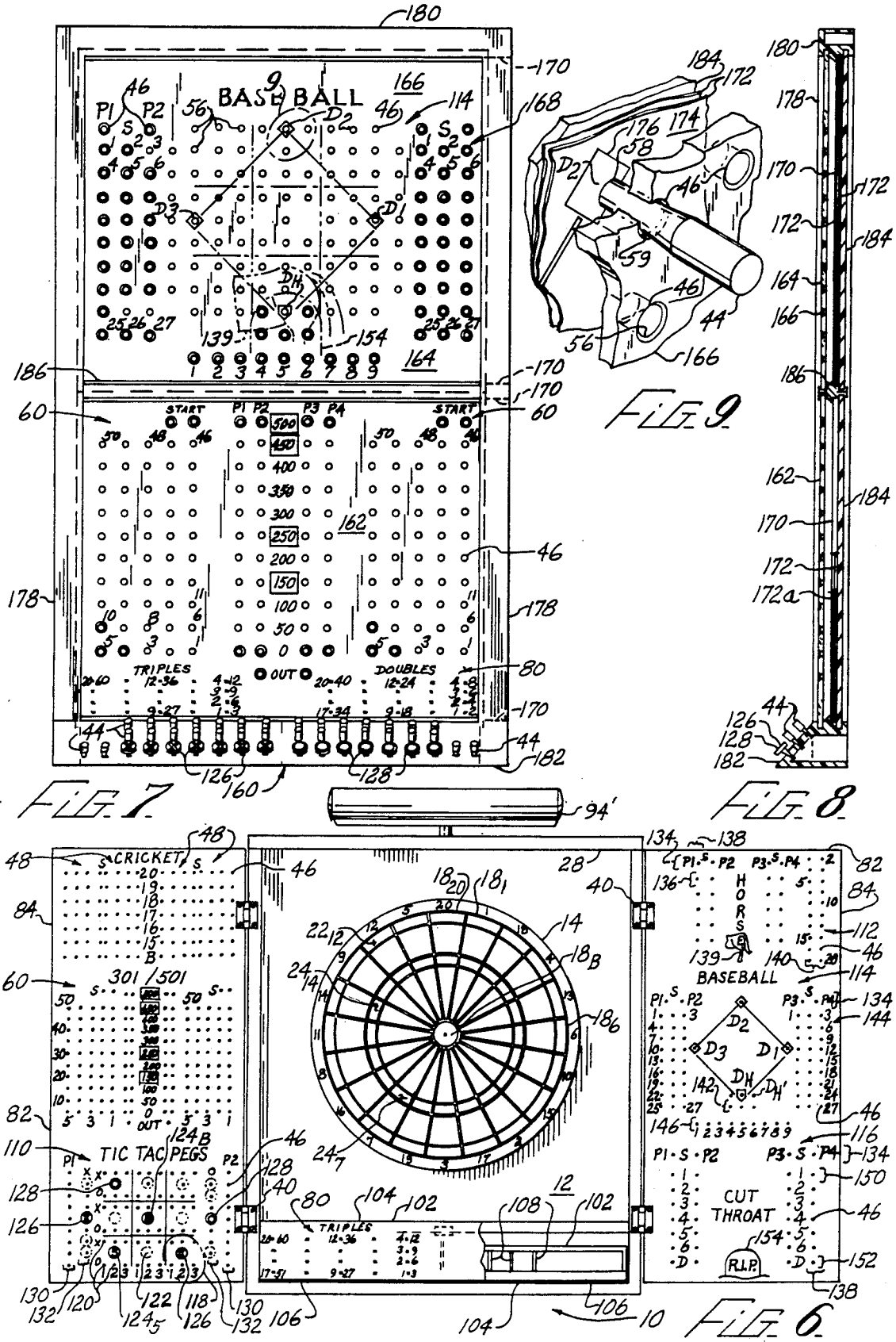
FIG. 6 is a front elevational view as in FIG. 5, showing another alternative configuration of the system of FIG. 1.
FIG. 7 is a front elevational view of a further alternative configuration of the system of FIG. 1
FIG. 8 is a right fragmentary sectional elevational view of the system of FIG. 7.
FIG. 9 is a fragmentary oblique detail view of the system of FIG. 7 within region 9 thereof.

With further reference to FIG. 6, another variation of the system 10 incorporates a fold-out bin 102 in place of the drawer 90, the bin 102 having a bin panel 104 that is pivotally connected to the bottom member 34 by a pair of bin hinges 106. The bin 102 is provided with a plurality of bin dividers 108 for conveniently segregating the darts 20 and the markers 44. Also, the system 10 includes a counterpart of the lamp assembly 94, designated 94' in FIG. 6. As shown in FIG. 6, the lamp assembly 94' extends upwardly from the top member 28, providing illumination of the target wall 12 from in front of the top member 28. As also shown in FIG. 6, the doors 82 are configured for scoring additional games as described herein. In particular, each of the doors 82 is configured with three different sets of the marker positions 46, there being a total of six different patterns on the doors 82. As shown in FIG. 6, one of the doors 82 incorporates the modular array 60, a quadruple form of the cricket array 48, and a tic-tac-pegs or tic-tac-darts array 110, described below. The other of the doors 82 incorporates a horse array 112, a baseball array 114, and a cut throat array 116.

The tic-tac-pegs array 110 includes a set of object patterns 118 of the marker positions 46 in a conventional $3 \times 3$ tic-tac-toe grid for two players, each of the object patterns 118 having a plurality of the marker positions 46, designated hit positions 120, for scoring multiple hits of a particular target region 18 to be made by a player entitling that player to mark the object pattern 118 with an "X" or an "O". Each of the object patterns 118 also has a mark position 122 for receiving a numbered segment marker 124, the segment marker 124 being subsequently replaced by either an X marker 126 or an O marker 128 when the marking of that grid position is to be recorded. The segment markers 124 are randomly selected from a set of such markers, designated $124_{1-20}$ and $124_B$, each of the segment markers 124 being numbered according to a different one of the regions 18 of the target 14. The tic-tac-pegs array 110 also includes for each player a pair of holding columns of the marker positions 46, designated hit holding column 130 and mark holding column 132. Each of the hit holding columns 130 is initially loaded with markers 44 having that player's color, and each of the mark holding columns is loaded with either the X markers 126 or the O markers 128. In the exemplary configuration of FIG. 6, one of the hold holding columns 130 is labeled "P1", the associated mark holding column 132 being labeled "X". The other player's hit holding column 130 is labeled "P2", the associated mark holding column 132 being labeled "O". Similarly, the hit positions 120 of each object pattern 118 are in a pair of rows, designed "X" and "O", respectively.

In preparation for play of Tic-Tac-Pegs, the segment markers $124_{1-20}$ are mixed, face down, and eight of the markers 124 are chosen at random and placed in the mark position 122 of sequential ones of the object patterns 118, except that the segment marker $124_B$ is arbitrarily used to mark the middle one of the object patterns 118. To mark either the X marker 126 or the O marker 128 in one of the mark positions 122, the player must hit the number shown on the segment marker 124 four times. If the dart 20 hits the doubles subregion 22 of an indicated target region 18, the player scores two hits in the corresponding object pattern 118. Similarly, if the dart 20 hits the triples subregion 24 of the target region 18, the player scores three hits in the object pattern 118. Once the player has scored four such hits, he removes the segment marker 124 and inserts the appropriate X marker 126 or O marker 128 in the mark position 122 of the object pattern 118. The play continues until one player has three of his X markers 126 or O markers 128 in a row. If a player scores more hits than needed for claiming the object pattern 118, the extra hits are accumulated on the modular array 60, as described above in connection with cricket. If neither player gets three of the markers 126 or 128 in a row (a situation otherwise known as "cat's game" in Tic-Tac-Toe), the extra hits are counted, the highest score winning.

The horse array 112 includes a start row 134, there being four of the marker positions 46 in the start row 134, a letter row 136 of the marker positions 46 for each of the letters "H", "O", "R", "S" and "E", the marker positions 46 also being arranged in separate player columns 138. As shown in FIG. 6, the "E" is located within a horse figure 139 that graphically depicts on the door 82 a rear horse portion for associating that letter row 136 with loss of the game. Also, there are four of the player columns 138, labeled "P1", "P2", "P3" and "P4", respectively, a marker position 46 being located at each intersection of a letter row 136 with one of the player columns 138.

In the play of Horse, the first player to start the game is known as the set player. Each player has three of the darts 20. The set player throws his first dart 20 at the target 14, and the number he hits on the target 14 becomes the set number. The horse array 112 further includes a region array portion 140 for conveniently displaying the set number. As shown in FIG. 6, the region array portion 140 is formed as a two by ten grid of the marker positions 44, the marker positions 44 being sequentially numbered for representing corresponding ones of the target segments $18_{1-18}$. The set number is conveniently displayed by placement of one of the markers 44 at the correspondingly numbered marker position 46 of the region array portion 140.

The set player also throws his remaining two darts, attempting to hit the same segment 18 as before. The doubles subregion 22 and a triples subregion 24 define game score values as corresponding multiples of the respective scoring values for that target region 18 when the dart 20 hits within one of the subregions 22 or 24. A par score is thus established as the total of the game score values for the three darts 20 of the set player.

The second player then throws his three darts 20 at the same set number, attempting to equal or exceed the par score. If he does not, his marker 44 is put in the marker position 46 in that player's column 136, in the letter row 136 of the letter "H". If the second player's score is more than the first player, he becomes the new set player and throws at the number of his choice on the target 14. The new set player also throws his remaining two darts 20 for generating a new par score. Play continues, with further player failures to meet the par score resulting in sequential advancement of that player's marker 44 to the other letter rows 136. The first player to spell out "horse" drops out of the game. The other players continue play until there is one winning player left.

The baseball array 114 includes a diamond pattern of the marker positions 46, designated $D_1$, $D_2$, $D_3$, and $D_H$ for respectively representing first, second, third base and home plate. Below the marker position $D_H$ is a batter row 142 of three marker positions 46, additional ones of the position $D_H$, designated $D_{H'}$ being located on opposite sides of the position $D_H$. The baseball array 114 further includes a counterpart of the start row 134 as described above in connection with Horse, at least one runs array portion 144 for recording runs scored by the respective players, and an inning row 146 of the marker positions 46 for indicating the current "inning" of the game. In the exemplary configuration of the baseball array 114 in FIG. 6, there are two of the runs array portions 144, each including 27 of the marker positions 46, labeled 1–27, for indicating the number of runs scored by each player. Also, there are four of the marker positions 46 in the start row 134 for players P1, P2, P3, and P4, one of the runs array portions 144 being used by a pair of the players, the markers 44 being stacked as described above when necessary for indicating a tied score.

The game of Baseball is played for nine innings and ends after the last player in the ninth inning has thrown his darts 20. Initially, each player positions a marker 44 of his color in one of the marker positions 46 of the start row 134. Another of the markers 44 is positioned in the first marker position 46 in the inning row 146 for indicating the first inning. Three more of the markers 44 are placed in the batter row 142. To start play, the first player throws his first and second darts 20 at the target region 18 on the target 14 that corresponds to the inning number. The player's third dart 20 may be thrown at the same target region 18 or at the region $18_B$ (the bull's-eye). A hit in the target region 18 for that inning scores a single base hit, except that a hit in the doubles subregion 22 is counted as a two base hit or "double", and a hit in the triples subregion 24 is similarly counted as a "triple". On the third dart 20 only, a hit in the target region $18_B$ is scored as a "home run" (four bases).

For example, if a player throws his first dart 20 in the doubles subregion 22 of the target region 18 for that inning, throws his second dart 20 in the triples subregion 24 of the same region 18, and throws his third dart 20 at the target region $18_B$ but misses, the player takes one of the markers 44 from the batter row 142 and puts it in the marker position $D_2$ (second base) for scoring his first dart 20. Then he moves the marker 44 to the marker position $D_H$ (home) and the second of the markers 44 to marker position $D_3$ (third base), thereby scoring his second dart 20. Because the third dart 20 missed, the third marker 44 is not moved. Accordingly, one run is scored for that player in the inning, by appropriately advancing the player's colored marker 44 in the runs array portion 144. The player then moves his marker 44 from the marker position 46 in the start row 134 to the marker position 46 representing one run in the runs array portion 144.

In a further example, if the player scores a double on his first dart 20, the first marker 44 in the batter row 142 is moved to $D_2$ (second base). If his second dart 20 scores a single, the first marker 44 is next moved to $D_3$ (third base), and the second marker 44 from the batter row 142 also is moved to $D_1$ (first base). If his third dart 20 then scores a triple, the first marker 44 is moved to $D_H$ (home), the second marker 44 is moved to $D_H$(home), and the third marker 44 in the batter row 142 is moved to $D_3$ (third).

The cut throat array 116 includes counterparts of the player columns 138 of the marker positions 46 for each of the players, each player column 138 having eight rows, including a counterpart of the start row 134, six numbered rows 150 sequentially numbered 1–6, and a "Dead" row 152. To set up the game, each player puts his marker 44 in the start row 134. Each player then throws one dart 20 at the target 14. The number of the target region 18 is that player's number throughout the game and his marker 44 is placed in the marker position 46 in the numbered array portion 154 indicating each player's number. If more than one player hits the same number, each of those players must throw another dart 20 until all the players have different numbers. Each player's number can be conveniently displayed for reference by use of the region array portion 140 of the horse array 112, separate ones of the markers 44, in the players' respective colors, being placed in correspondingly numbered marker positions 46 of the region array portion 140.

The object of Cut Throat is for each player to throw his darts 20 at another player's number. Each time a player's number has been hit, the player's marker 44 in the start row 134 is moved down one marker position in the numbered rows 150. Once a player has been hit seven times, he is "dead" and drops out of the game, his marker 44 coming to rest in the "Dead" row 152. Appropriately, the dead row 152 is illustrated with a tomb stone character 154. Play continues until one player, the winner, is left.

Each of the above-described games is designed to be played by from two to four players, or from two to four teams, except that Tic-Tac-Pegs is played by two players or two teams. In each of the games, the players (or one player of each team) throws one dart 20 at the bulls-eye $18_B$. The players determine which of them is to play first (P1), second (P2), third (P3), or fourth (P4) according to the players hitting closest to the center of the bull's-eye $18_B$.

The scoring system 10 of the present invention can be inexpensively fabricated from wood or molded from plastic, the target wall 12 being lined with cork and covered with a suitable burlap material.

With further reference to FIGS. 7 and 8, another and important configuration of the present invention provides at least a score-keeping portion of the system 10 in a modular frame assembly 160. The frame assembly 160 holds a counterpart of the scoring panel 38, designated 38' in FIG. 8. The panel 38' has one or more of the modular arrays 60 in a first panel region 162, the panel 38' also including a convertible second panel region 164 for interchangeably scoring a variety of additional games as described herein. The modular arrays 60 of the first panel region 162 permit scoring of the 301 Series games as described above, and also provide a convenient means for recording extra points that are awarded in certain ones of the additional games, such as in Cricket, and in Tic-Tac-Pegs, also described above. The second panel region 164 is formed by a transparent grid panel 166 having a grid array 168 of the marker positions 46, at least some of the positions 46 of the array 168 being used in common between alternative ones of the additional games. For ease of manufacture, the panel regions 162 and 164 are formed from the same transparent material, in separate equally sized modules as further described herein. A card slot 170 is formed behind the grid panel 166 for receiving one or more game cards 172, a selected one of the game cards 172 that is directly facing the grid panel 166 being positioned in registration therewith for scoring according to a game pattern 174 that is printed or otherwise presented thereon. For convenience, another of the card slots 170 is also formed behind the first panel region 162, one of the game cards 172, designated **172*a* in FIG. 7, being configured for exclusive use in connection with the modular arrays 60 of the first panel region 162. Also, the game card 172*a* incorporates the multiples chart 80, described above. Further, one or more of the game cards 172 can be stored, when not in use, in the slot 170 behind the card 172*a***.

In the exemplary configuration of the frame assembly 160 shown in FIGS. 7–9, the grid panel 166 is formed of Plexiglas®, the holes 56 extending therethrough, each of the holes 56 having the countersink 59 as also shown and described in above in connection with FIG. 4. Each of the slots 170 is spaced slightly behind the scoring panel 38' for accommodating inwardly protruding portions of the markers 44 without interference with the game cards 172.

Alternatively, the scoring panel 38' can be formed having sufficient thickness that the markers 44 do not protrude beyond the rear thereof, such that the game card 172 that is in use can directly contact the panel 38'.

The game pattern 174 of each of the game cards 172 includes a plurality of marker symbols 176 for identifying particular ones of the holes 56 to be used with that pattern 168. As shown in FIG. 9, an exemplary and preferred form of the marker symbol 176 is a circular spot or "bullet" that is somewhat larger in diameter than the associated hole 56. In this form, the symbol 176 is visible through the grid panel 166 even when a marker 44 occupies the associated hole 56, for verifying proper placement of the markers 44 in active ones of the holes 56 for the game card 172 that is in use.

The frame assembly 160 includes a pair of side frame members 178 that are rigidly connected by any suitable means to a top frame member 180 and a bottom frame member 182, the scoring panel 38' being securely retained by the frame members 178, 180 and 182 as best shown in FIG. 8. A pair of backing panels 184, which can be formed with the same outline as the modules forming the panel regions 162 and 164 of the scoring panel 38', are similarly retained by the frame members 178, 180 and 182. A slotted rib member 186 extends between the side frame members 178 for enhancing support of adjacent portions of the panel regions 162 and 164 properly spaced from the backing panels 182.

Although the present invention has been described in considerable detail with reference to certain preferred versions thereof, other versions are possible. Therefore, the spirit and scope of the appended claims should not necessarily be limited to the description of the preferred versions contained herein.

What is claimed is:

1. A scoring system for a dart game apparatus having a target and a plurality of darts for shooting at selected regions of the target, each of the regions having an associated scoring value for generating a corresponding intermediate outcome when a dart hits that region of the target, the system comprising:

(a) a supply of markers for use by players of the game;

(b) a scoring panel comprising:

(i) a modular pattern of marker positions on the scoring panel, the positions forming at least one distinct array portion;

(ii) means for releasably holding one or more of the markers in association with a selected marker position; and (c) selector means for removably registering a selected game pattern of score keeping indicia relative to the scoring panel, each of the indicia being visually associated with one of the marker positions and defining a scoring indicator for the associated marker position, wherein progress of the game is indicated by the positioning of markers in the array portion.

2. The system of claim 1, wherein the modular pattern is a first modular pattern, the panel also having a second modular pattern of the marker positions forming at least two distinct array portions and comprising means for indicating a game score value as a summation of the position of each marker in its array portion multiplied by a scoring increment of that portion.

3. The system of claim 1, wherein at least one array portion comprises a rectangular first sub-array having a first number of positions in one direction and a second number of positions in an orthogonal direction, the indicia defining the scoring increment in the one direction and the scoring increment multiplied by the first number in the orthogonal direction.

4. The system of claim 3, wherein the array portion further comprises a second sub-array, a scoring increment of the second sub-array of the marker positions being the product of the scoring increment of the first sub-array, the first number of positions, and the second number of positions.

5. The system of claim 4, wherein the scoring increment of the first sub-array is unity, the first number is five, the second number is ten, and the scoring increment of the second sub-array is fifty.

6. The system of claim 5, wherein the first sub-array further comprises a starting position, the starting position having an associated indicia for a value of 51.

7. The system of claim 1, including at least two visually distinctive kinds of the markers for association with corresponding players of the game.

8. The system of claim 7, wherein at least one of the array portions is capable of receiving at least two of the kinds of markers in each position for permitting opponents' markers to simultaneously occupy a single position of the array portion.

9. The system of claim 7, wherein the panel is formed with an opening at each marker position, and wherein each marker comprises a body portion and a stem portion for engaging a selected opening of the panel, at least some of the markers having a body cavity for receiving a stem portion of another marker whereby the markers of opposing players may be stacked.

10. The system of claim 1, wherein at least a portion of the panel is formed from a transparent material, and the selector means comprises:

(a) a selector substrate having indicia for the selected pattern formed thereon; and (b) means for locating the substrate for viewing through the panel portion, the indicia of the substrate being visible through the panel portion.

11. The system of claim 10, wherein the means for locating the substrate comprises a substrate cavity for receiving a stack of the selector substrates, the selected substrate being located at a front extremity of the stack most proximate the panel portion.

12. The system of claim 1, wherein the apparatus provides at least one game wherein a predetermined number of occurrences of at least one of the game score values is required for a player to win the game, and the indicia define for at least one of the array portions a scoring value and a required number of occurrences of the scoring value for each of the array portions.

13. The system of claim 12, wherein the target comprises a bull's-eye region and at least six other labeled regions, and the panel includes at least seven array portions, the seven array portions having associated indicia corresponding, respectively, to the bull's-eye region and each of the six labeled regions, each of the seven array portions having at least three marker positions for recording a like number of the required occurrences.

14. The system of claim 13 wherein at least some of the target regions have at least one subregion for defining an associated predetermined multiple of the scoring value, the apparatus providing at least one game in which the predetermined multiple of the scoring value is used as the game score value, the system further comprising a chart of the scoring value and associated game score values for each of the regions and subregions of the target.

15. The system of claim 1, further comprising:

(a) a target wall for mounting a dart board, the target wall being connected to the scoring panel; and (b) means connected to the target wall for storing the markers.

16. A scoring system for a dart game apparatus having a target and a plurality of darts for shooting at selected regions of the target, each of the regions having an associated scoring value for generating a corresponding game score value when a dart hits that region of the target, the apparatus providing at least one game wherein a predetermined number of occurrences of at least one of the game score values is required for a player to win the game, the system comprising:

(a) a supply of markers for use by players of the game; and (b) a scoring panel comprising:

(i) a modular pattern of marker positions on the scoring panel, the positions forming at least one array portion;

(ii) a pattern of score keeping indicia on the scoring panel, each of the indicia being associated with at least one of the marker positions of not more than one of the array portions, the indicia defining a required number of occurrences of a scoring value for each of the array portions; and (iii) means for releasably holding one or more of the markers in association with a selected indicia for recording each required occurrence of a game score increment; and (c) means for defining the scoring value for each of the array portions.

17. The system of claim 16, wherein the target comprises a bull's-eye region and at least six other labeled regions, and the panel includes at least seven array portions, the means for defining the scoring value comprising the seven array portions having associated indicia corresponding, respectively, to the bull's-eye region and each of the six labeled regions, each of the seven array portions having at least three marker positions for recording a like number of the required occurrences.

18. The system of claim 16, wherein the means for defining the scoring value comprises a portion of the markers forming a set of labeled markers, each of the labeled markers being labeled in association with a particular one of the target regions, and means for randomly selecting a subset of the labeled markers.

19. The system of claim 18, wherein each of the labeled markers includes a head portion having a face region for its label, the markers being movable face-down on a supporting surface without revealing the labels.

whereby the labeled markers of the subset are sequentially selectable for location on the panel in association with successive ones of the array portions.

20. A scoring system for a dart game apparatus having a target and a plurality of darts for shooting at selected regions of the target, each of the regions having an associated scoring value for generating a corresponding game score value when a dart hits that region of the target, the apparatus providing at least one game wherein one or more occurrences of at least one preselected game score value is required for a player to win the game, the system comprising:

(a) a supply of markers for use by players of the game; and (b) a scoring panel comprising:

(i) a modular pattern of marker positions on the scoring panel, the positions forming a play array portion, and at least one marker position for displaying a required game score value;

(ii) a pattern of score keeping indicia on the scoring panel, each of the indicia being associated with one of the marker positions of the play array portion for indicating a number of occurrences of the required game score value; and (iii) means for releasably holding one or more of the markers in association with a selected indicia for recording each occurrence of a required game score increment.

21. The system of claim 20, wherein a predetermined number of occurrences of required game score values is required for a player to win the game, the play array portion including a player array portion for each of the players, the pattern of score keeping indicia defining the required number of occurrences of the required game score values.

22. The system of claim 21, wherein a portion of the markers forms a set of labeled markers, each of the labeled markers being labeled in association with a particular one of the target regions, a selected one of the labeled markers being used in the marker position for displaying the required game score value.

23. The system of claim 22, wherein the panel includes marker positions for indicating required game score values separately associated with each of the players.

24. The system of claim 21, wherein the pattern of marker positions includes a value array portion having a marker position for the game score value associated with at least some of the target regions, a portion of the score keeping indicia indicating the game score values of the value array portion.

25. The system of claim 20, wherein the play array portion includes a path portion having a plurality of the marker positions and associated indicia, one of the path portion marker positions being associated with a game point value, the play array portion also including a game point array portion for accumulating separate game point values for each of the players.

* * * * *